US005769047A

United States Patent [19]

Zoche

[11] Patent Number: 5,769,047

[45] Date of Patent: Jun. 23, 1998

[54] ENGINE WITH OIL SEPARATOR

[76] Inventor: Michael Zoche, Keferstrasse 13, 80802 Munchen, Germany

[21] Appl. No.: 701,556

[22] PCT Filed: Dec. 23, 1991

[86] PCT No.: PCT/DE91/01001

§ 371 Date: Oct. 5, 1994

§ 102(e) Date: Oct. 5, 1994

[87] PCT Pub. No.: WO93/13302

PCT Pub. Date: Jul. 8, 1993

Related U.S. Application Data

[63] Continuation of Ser. No. 256,009, Oct. 5, 1994, abandoned.

[51] Int. Cl.[6] ..... F01M 11/06

[52] U.S. Cl. ..... 123/196 R; 184/6.2

[58] Field of Search ..... 123/196 R, 196 CP, 123/195 C; 184/6.2, 6.23, 11.4, 11.2

[56] References Cited

U.S. PATENT DOCUMENTS

| | | | |
|---|---|---|---|
| 1,270,606 | 6/1918 | Ducorron | 184/11.4 |
| 1,528,171 | 3/1925 | Tokarczike | 184/11.4 |
| 2,030,647 | 2/1936 | McMillin et al. | 184/11.4 |
| 2,050,723 | 8/1936 | McMillin | 184/11.4 |
| 3,045,411 | 8/1962 | Dalrymple . | |
| 4,773,366 | 9/1988 | Seidl et al. | 123/196 R |
| 5,452,692 | 9/1995 | Spray et al. | 123/195 C |

FOREIGN PATENT DOCUMENTS

| | | | |
|---|---|---|---|
| 0 187 263 | 7/1986 | European Pat. Off. . | |
| 618367 | 3/1927 | France . | |
| 4128052 | 2/1993 | Germany | 184/11.2 |
| 2539 | 11/1912 | United Kingdom . | |
| 881546 | 11/1961 | United Kingdom . | |

*Primary Examiner*—Erick R. Solis
*Attorney, Agent, or Firm*—Oblon, Spivak, McClelland, Maier & Neustadt, P.C.

[57] ABSTRACT

In order to remove oil from the engine, i.e. to evacuate lubricant oil from the crankcase (1), the crankcase and the rotating parts (6, 2, 3) therein are designed so that a centrifugal flow is generated in the crankcase (1) and is used to separate the engine oil from the air that surrounds it. Preferably, only a small gap (8) remains between the outermost partially cylindrical rotating parts, in particular the counterweight (6), and the inner wall of the cylindrical crankcase (1). The oil is removed through an outlet (10) that extends tangentially out of the crankcase (1).

5 Claims, 1 Drawing Sheet

ENGINE WITH OIL SEPARATOR

This application is a continuation of application(s) Ser. No. 08/256,009 filed on Oct. 5, 1994 now abandoned.

BACKGROUND OF THE INVENTION

One problem that exists in engines is reliable removal of oil from the engine housing during every stage of operation of the engine. The engine oil is customarily collected in a so-called sump, that is, "below" in the crankcase outside the rotating parts, such as crankshaft, counterweight, etc., of the engine. Such a method of oil removal is critical, for instance, in aircraft engines for acrobatic airplanes which remain, for a long time, substantially in upside down position, but also in conventional automobile engines when oil reaches the area of the rotating parts as result of transverse accelerations. For lubrication technique reasons, it must be ensured that the removal of oil, that is, the drawing of the oil out of the crankcase, be as free of air as possible so that no foam forms in the oil.

It has been sought to remove the oil by additional pumps. On one hand, this involves considerable expenses and, in addition, does not ensure air-free conveyance of the oil since the pumps, which run continuously, of necessity deliver air even in the case of small amounts of oil.

SUMMARY OF THE INVENTION

The problem on which the invention is based is to ensure removal of oil by means of a simple construction which guarantees that the oil will be completely removed from the crankcase and practically free of air.

According to the invention, this is obtained by the fact that the parts of the engine that rotate in the crankcase, that is, the crankshafts, the crankpins, the piston rods and the counterweights, are surrounded by an engine housing with a spacing such that only a small gap remains between the surface circumscribing the rotating parts and the crankcase so as to generate, in the crankcase by means of the rotating parts, a centrifugal flow which is used for conveying the oil. The oil is removed from the crankcase through an outlet that extends tangentially out of the crankcase. The centrifugal force acting upon the oil is substantially stronger than gravity acting upon the oil and thus the outlet can be situated at any desired place in the cylindrical crankcase. Air and oil are necessarily separated from each other by the centrifugal forces. By dimensioning the downflow resistance through the outlet, it can be obtained that only oil and not air exits from the outlet.

For the rest it is not necessary that the crankcase be adapted in shape exactly to the external surface that circumscribes all of the rotating parts, that is, adapted especially in shape to the rolling of the crankshaft; it is, to the contrary, sufficient that the innerwall of the crankcase be generally cylindrical and the crankcase be on both sides of the crankshaft, locked as tightly as possible to the rotating parts. A separate outlet is preferably provided for each cylinder.

BRIEF DESCRIPTION OF THE DRAWINGS

One embodiment of the invention is explained in detail with reference to the diagrammatic drawings. In the drawings.

DESCRIPTION OF THE PREFERRED EMBODIMENT

Figure 1:
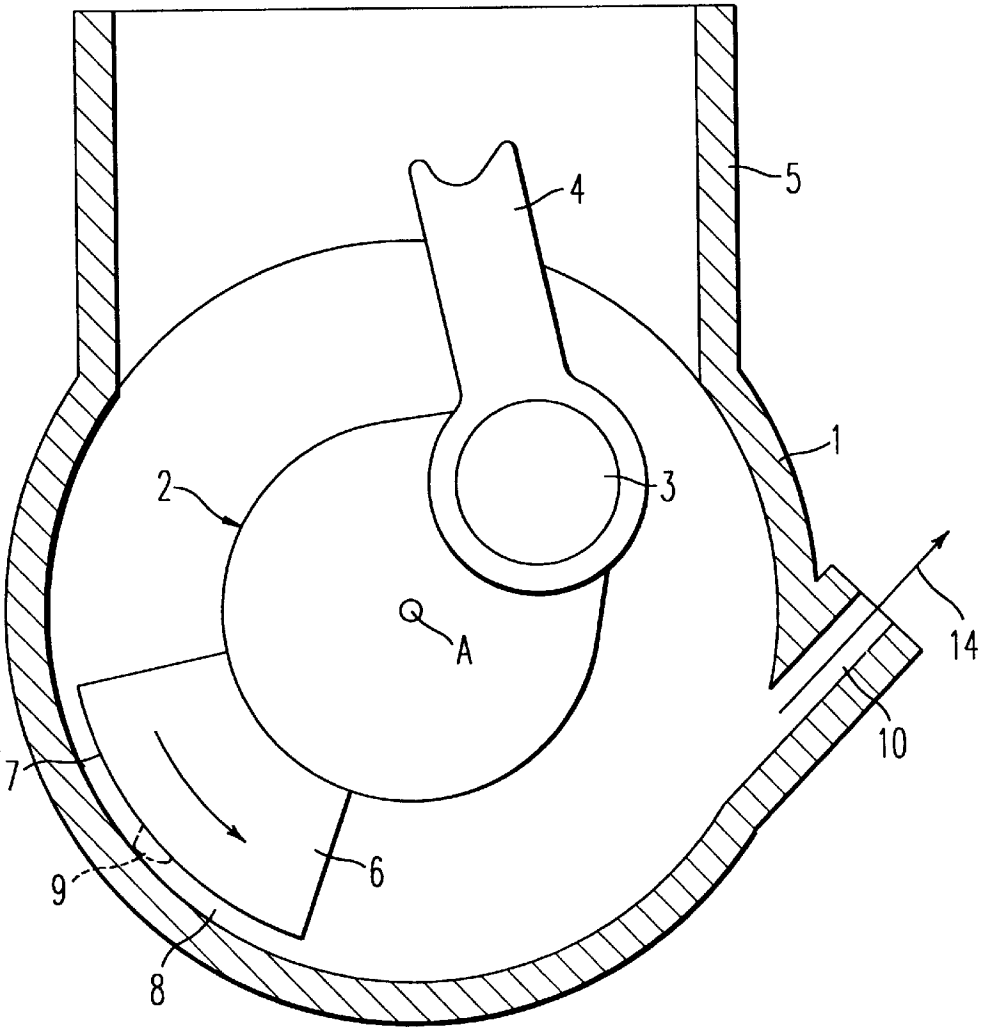
FIG. 1 is a cross section through one part of a engine.

A cylindrical crankcase 1 for a crankshaft 2, with crankpins 3 on which are hinged piston rods 4 which lead to pistons, not shown, that slide to and fro in a cylinder 5, is shown in FIG. 1. The crankshaft 2 rotates about its shaft axle A. The crankshaft 2 is connected with counterweights 6 for the piston rods and the pistons, and a small gap 8 remains between the partially cylindrical underside 7 of the counterweight 6 and the inner wall of the crankcase 1. A slide or wiper 9 can also be provided on the bottom of the counterweight which slides directly on the inner wall of the crankcase 1 or in a groove in the inner wall. An outlet 10, leading substantially tangentially out of the crankcase, is provided on the cylindrical crankcase.

Figure 2:
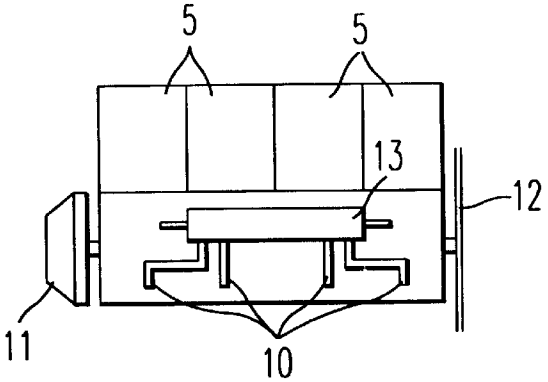
FIG. 2 is a diagrammatic side view of an in-line four-cylinder engine.

A side view of an in-line four-cylinder engine, with the cylindrical crankcase 1 and the four cylinders 5, is diagrammatically shown in FIG. 2. A flywheel 11 with a clutch and a ventilator 12, for cooling, are additionally connected with the crankshaft. An outlet 10, respectively connected via pipes with a reservoir 13 for the lubricating oil of the engine, is provided for each crank space.

When engine oil is in the crankcase 1, the rotating parts of the crankshaft produce, in the cylindrical area of the crankcase 1, a centrifugal flow by which the engine oil, which may eventually be present in the crankcase, is driven out through the outlet 10, as indicated by an arrow 14, and collected in the receptacle 13. The oil, in turn, is led back from said receptacle into the crankcase as lubricating oil. The oil is substantially driven out by the centrifugal flow generated in the crankcase 1 and not necessarily by the mechanical contact with the counterweight 6 or the wiper 9.

The described oil removal takes place in all positions of the crankcase 1.

It also is unnecessary for the whole crankcase to be cylindrical; only in a few important areas need to be designed cylindrically for oil removal in which the oil can be introduced into the flow and discharged via outlet bores. The design of the counterweight 6 is particularly important since, as a rule, it has the largest radius. The underside 7 of the counterweight also determines said outer surface that circumscribes the rotating parts in the crankcase and which is to be thought of almost as a continuation of the partially cylindrical underside of the counterweight 6. The other rotating parts in the crankcase, especially the crankpins, of course also contribute to said centrifugal flow. The width of the counterweight, in the direction of the shaft axle A, must be selected as large as possible for a good removal of oil.

The described oil removal is adequate for all kinds of engines, whether they are diesel engines, Otto engines, in-line engines, or even radial engines. Especially for the latter, the rotating parts and the crankcase can be very well designed according to the invention.

I claim:

1. An engine capable of sustained operation in any orientation having a plurality of components comprising: a crankcase (1), a crankshaft (2) having a shaft axis, at least one piston rod (4) hinged on a crankpin (3) of said crankshaft (2), a piston, a cylinder (5), one piston being located within each cylinder (5) and being connected with one piston rod, and the engine has at least one counterweight (6);

said plurality of components being lubricated with engine oil via lubrication points and being connected with means for removing oil from said crankcase;

wherein some of said plurality of components are rotating components that rotate about said shaft axis, an inner wall of said crank-case (1) closely surrounds said rotating components in a manner such that only a small gap results between the inner wall of the crankcase and at least one of said rotating components, said small gap being sufficiently small to produce, during use, an oil flow along said inner wall, and wherein a plurality of oil outlets are provided in the inner wall of said crankcase which all extend substantially tangentially out of said crankcase oriented and located to receive oil flowing along the inner wall and discharge that oil to an oil circulation system whereby said rotating components produce, during use, a centrifugal flow in said crankcase (1) in which the engine oil in said crankcase separates from surrounding air, flows along the inner wall, is driven out of said crankcase through said plurality of oil outlets and is conveyed to the lubrication points of said crankcase.

2. An engine according to claim 1, wherein said crankcase (1) is cylindrically designed, at least in areas provided for discharge of engine oil, and said small gap (8) is provided in an area between said inner wall of said crankcase and the outer surface of said counterweight (6).

3. An engine according to claim 2, wherein an outer surface of said counterweight (6) is at least partially cylindrical in shape.

4. An engine having a plurality of components comprising a crankcase (1), a crankshaft (2) having a shaft axis, at least one piston rod (4) hinged on a crankpin (3) of said crankshaft (2), a piston, a cylinder (5), one piston being located within each cylinder (5) and being connected with one piston rod, and the engine has at least one counterweight (6);

said plurality of components being lubricated with engine oil via lubrication points and being connected with means for removing oil from said crankcase;

wherein some of said plurality of components are rotating components (2, 3, 6) that rotate about said shaft axis, an outer surface of said at least one counter weight (6) is at least partially cylindrical in shape and has a larger radius of rotation than any other rotating component, an inner wall of said crank-case (1) is cylindrically designed, at least in areas provided for discharge of engine oil, and closely surrounds said rotating components (2, 3, 6) in a manner such that only a small gap results between said inner wall of said crankcase and said outer surface of said at least one counter weight, said small gap is sufficiently small to produce, during use, an oil flow along said inner wall, at least one oil outlet (10) is provided in said inner wall of said crankcase, said at least one oil outlet (10) extends substantially tangentially out of said crankcase, has an axis substantially in the direction of said oil flow along said inner wall and discharges into an oil circulation system connected with the lubrication points, no oil outlet (10) provided in said inner wall extends substantially tangentially out of said crankcase with an axis substantially in an opposite direction of said oil flow along said inner wall, and a slide (9) which engages one of said inner wall and a groove of said crankcase (1) is connected with said crankshaft (2), whereby said rotating components (2, 3, 6) in said crankcase (1) produce, during use, a centrifugal flow in said crankcase (1) in which the engine oil in said crankcase separates from surrounding air, flows along said inner wall, is driven out of said crankcase through said at least one oil outlet, and, thereafter, is conveyed to the lubrication points of said crankcase.

5. An engine having a plurality of components comprising a crankcase (1), a crankshaft (2) having a shaft axis, at least one piston rod (4) hinged on a crankpin (3) of said crankshaft (2), a piston, a cylinder (5), one piston being located within each cylinder (5) and being connected with a piston rod, and the engine has at least one counterweight (6);

said plurality of components being lubricated with engine oil via lubrication points and being connected with means for removing oil from said crankcase;

wherein some of said plurality of components are rotating components (2, 3, 6) that rotate about said shaft axis, an outer surface of said at least one counter weight (6) is at least partially cylindrical in shape and has a larger radius of rotation than any other rotating component, an inner wall of said crank-case (1) is cylindrically designed, at least in areas provided for discharge of engine oil, and closely surrounds said rotating components (2, 3, 6) in a manner such that only a small gap results between said inner wall of said crankcase and said outer surface of said at least one counter weight, said small gap is sufficiently small to produce, during use, an oil flow along said inner wall, at least one oil outlet (10) is provided in said inner wall of said crankcase, said at least one oil outlet (10) extends substantially tangentially out of said crankcase, has an axis substantially in the direction of said oil flow along said inner wall and discharges into an oil circulation system connected with the lubrication points, no oil outlet provided in said inner wall extends substantially tangentially out of said crankcase with an axis substantially in an opposite direction of said oil flow along said inner wall, and a slide (9) which engages one of said inner wall and a groove of said crankcase (1) is connected with said outer surface (7) of said counterweight (6), whereby said rotating components (2, 3, 6) in said crankcase (1) produce, during use, a centrifugal flow in said crankcase (1) in which the engine oil in said crankcase separates from surrounding air, flows along said inner wall, is driven out of said crankcase through said at least one oil outlet, and, thereafter, is conveyed to the lubrication points of said crankcase.

* * * * *